US007849930B2

(12) United States Patent
Chalker et al.

(10) Patent No.: US 7,849,930 B2
(45) Date of Patent: Dec. 14, 2010

(54) SWELLABLE PACKER CONSTRUCTION

(75) Inventors: Christopher J. Chalker, Aberdeen (GB); Kristian Solhaug, Hafrsfjord (NO); Gerrard P. Kennedy, Stavanger (NO); Alf Kolbjorn Sevre, Hundvaag (NO)

(73) Assignee: Halliburton Energy Services, Inc., Houston, TX (US)

( * ) Notice: Subject to any disclaimer, the term of this patent is extended or adjusted under 35 U.S.C. 154(b) by 266 days.

(21) Appl. No.: 11/852,295

(22) Filed: Sep. 8, 2007

(65) Prior Publication Data

US 2008/0078561 A1 Apr. 3, 2008

(51) Int. Cl.
*E21B 33/12* (2006.01)

(52) U.S. Cl. ..... 166/387

(58) Field of Classification Search ..... 166/387, 166/179, 187

See application file for complete search history.

(56) References Cited

U.S. PATENT DOCUMENTS

| | | | | |
|---|---|---|---|---|
| 1,736,254 | A | 11/1929 | Davis | |
| 2,144,026 | A | 1/1939 | Park | |
| 2,814,947 | A | 12/1957 | Stegemeier | |
| 2,828,823 | A | 4/1958 | Mounce | |
| 2,849,070 | A | 8/1958 | Maly | |
| 2,945,541 | A | 7/1960 | Maly et al. | |
| 3,385,367 | A | 5/1968 | Kollsman | |
| 4,234,197 | A | 11/1980 | Amancharla | |
| 4,375,240 | A | 3/1983 | Baugh et al. | |
| 4,444,403 | A | 4/1984 | Morris | |
| 4,862,967 | A | 9/1989 | Harris | |
| 5,327,962 | A | 7/1994 | Head | |
| 5,433,269 | A | 7/1995 | Hendrickson | |
| 5,876,042 | A | 3/1999 | Graf et al. | |
| 5,944,322 | A | 8/1999 | Coff et al. | |
| 6,009,951 | A * | 1/2000 | Coronado et al. | 166/387 |
| 6,318,729 | B1 | 11/2001 | Pitts, Jr. et al. | |
| 6,354,372 | B1 | 3/2002 | Carisella et al. | |
| 6,705,615 | B2 | 3/2004 | Milberger et al. | |

(Continued)

FOREIGN PATENT DOCUMENTS

| | | |
|---|---|---|
| RU | 2157440 | 10/2000 |

(Continued)

OTHER PUBLICATIONS

International Search Report and Written Opinion issued for PCT/US06/35052 dated Feb. 21, 2007 (8 pages).

(Continued)

*Primary Examiner*—William P Neuder
(74) *Attorney, Agent, or Firm*—Marlin R. Smith

(57) ABSTRACT

A swellable packer construction. A method of forming an annular barrier in a well includes the steps of: embedding a reinforcement material within a swellable seal material to form a seal assembly; and swelling the seal material by contacting the seal material with well fluid. A method of constructing a well packer includes the steps of: embedding a reinforcement material in a swellable seal material to form a seal assembly; and then installing the seal assembly on a base pipe. A swellable packer construction comprises a seal assembly including a swellable seal material having a reinforcement material embedded therein, the seal material being cylindrical shaped and disposed both external and internal relative to the reinforcement material, and the seal material being swellable in response to contact with well fluid.

26 Claims, 4 Drawing Sheets

U.S. PATENT DOCUMENTS

| | | | | |
|---|---|---|---|---|
| 6,834,725 | B2 | 12/2004 | Whanger et al. | |
| 7,059,415 | B2 | 6/2006 | Bosma | |
| 7,143,832 | B2 | 12/2006 | Freyer | |
| 2004/0020662 | A1 | 2/2004 | Freyer | |
| 2005/0199401 | A1 | 9/2005 | Patel | |
| 2007/0151724 | A1 * | 7/2007 | Ohmer et al. | 166/187 |
| 2007/0205002 | A1 | 9/2007 | Baaijens et al. | |
| 2007/0257405 | A1 | 11/2007 | Freyer | |
| 2008/0308283 | A1 | 12/2008 | Freyer | |

FOREIGN PATENT DOCUMENTS

| | | | |
|---|---|---|---|
| WO | 2005/116394 | | 12/2005 |
| WO | 2006118470 | A1 | 11/2006 |
| WO | 2005/090741 | | 9/2007 |

OTHER PUBLICATIONS

Freecap brochure, Tam International, undated. www.tamintl.com/pages/FREECAP/FreeCap1.html retrieved on Jul. 29, 2006.

International Search Report and Written Opinion issued for International Patent Application No. PCT/US07/61703 dated Mar. 21, 2008 (7 pages).

International Preliminary Report on Patentability issued Mar. 26, 2009, for International Patent Application Serial No. PCT/US07/35052, 5 pages.

International Preliminary Report on Patentability with Writen Opinion issued Apr. 20, 2009, for International Patent Application Serial No. PCT/US07/61703, 7 pages.

Office Action issued Jun. 16, 2010, for U.S Appl. No. 12/016,600, 47 pages.

Russian Office Action issued Apr. 28, 2010, for Russian Patent Application Serial No. 2009113625, 4 pages.

English Translation of Russian Office Action undated, for Russian Patent Application Serial No. 2009113625, 2 pages.

Russian Office Action issued Jan. 11, 2010, for Russian Patent Application Serial No. 2009113625, 2 pages.

English Translation of Russian Office Action issued Jan. 11, 2010, for Russian Patent Application Serial No. 2009113625, 2 pages.

* cited by examiner

SWELLABLE PACKER CONSTRUCTION

CROSS-REFERENCE TO RELATED APPLICATION

The present invention claims the benefit under 35 USC §§119 and 365 of the filing date of International Application No. PCT/US2006/035052, filed Sep. 11, 2006. The entire disclosure of this prior application is incorporated herein by this reference.

BACKGROUND

The present invention relates generally to equipment utilized and operations performed in conjunction with a subterranean well and, in an embodiment described herein, more particularly provides a swellable packer construction.

The benefits of using swellable seal materials in well packers are well known. For example, typical swellable seal materials can conform to irregular well surfaces (such as corroded or damaged casing, or uncased wellbores, etc.) and can be expanded radially outward without use of complex and potentially failure-prone downhole mechanisms.

Prior methods of constructing swellable well packers typically include molding or otherwise bonding the swellable material onto a tubular base pipe. Differently configured base pipes are used for different situations, for example, where different tensile strengths, different threaded connections, different materials, etc. are required.

Unfortunately, these prior methods of constructing swellable packers require that many different configurations be manufactured, inventoried, appropriately distributed, etc. This increases the cost of providing suitable swellable packers to the industry, and reduces the convenience of using swellable packers.

Therefore, it may be seen that improvements are needed in the art of swellable packer construction.

SUMMARY

In carrying out the principles of the present invention, a swellable packer construction is provided which solves at least one problem in the art. One example is described below in which a seal assembly including a swellable seal material may be used on a variety of different base pipe configurations, thereby eliminating the need to manufacture and inventory a separate packer construction for each different base pipe configuration. Another example is described below in which the seal assembly includes a reinforcement material embedded in the swellable seal material, thereby providing a more rigid seal assembly suitable for installation on a base pipe.

In one aspect of the invention, a method of forming an annular barrier in a subterranean well is provided. The method includes the steps of: embedding a reinforcement material within a swellable seal material to thereby form a seal assembly; and swelling the seal material by contacting the seal material with well fluid in the well.

In another aspect of the invention, a method of constructing a well packer includes the steps of: embedding a reinforcement material in a swellable seal material to thereby form a seal assembly; and then installing the seal assembly on a base pipe.

In yet another aspect of the invention, a swellable packer construction comprises a seal assembly including a swellable seal material having a reinforcement material embedded therein. The seal material is cylindrical shaped and is disposed both external and internal relative to the reinforcement material. The seal material is swellable in response to contact with well fluid.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
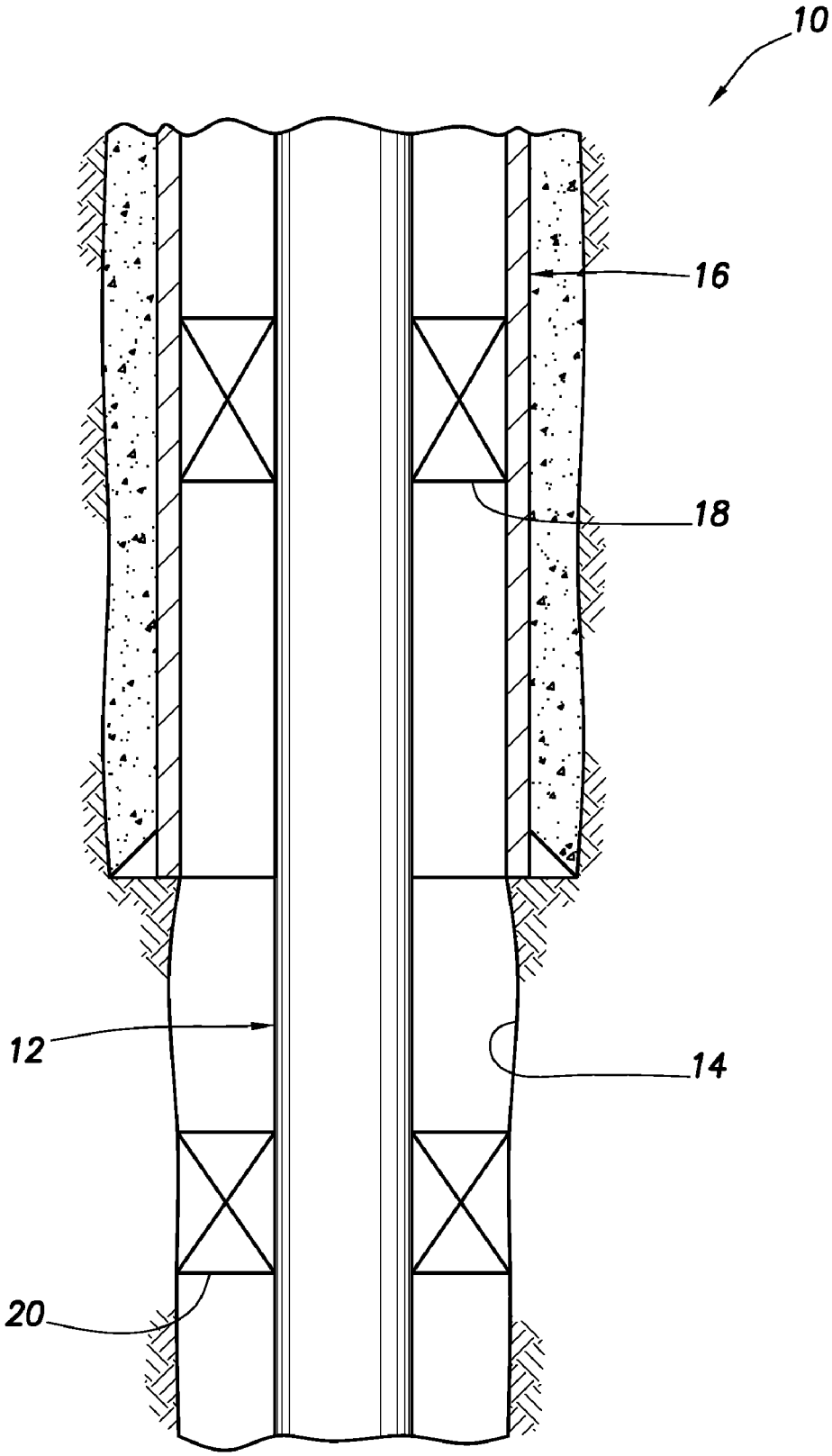
FIG. 1 is a schematic partially cross-sectional view of a well system embodying principles of the present invention.

Representatively illustrated in FIG. 1 is a well system 10 which embodies principles of the present invention. In the well system 10, a tubular string 12 (such as a production tubing string, liner string, etc.) has been installed in a wellbore 14. The wellbore 14 may be fully or partially cased (as depicted with casing string 16 in an upper portion of FIG. 1), and/or the wellbore may be fully or partially uncased (as depicted in a lower portion of FIG. 1).

An annular barrier is formed between the tubular string 12 and the casing string 16 by means of a swellable packer 18. Another annular barrier is formed between the tubular string 12 and the uncased wellbore 14 by means of another swellable packer 20.

However, it should be clearly understood that the packers 18, 20 are merely two examples of practical uses of the principles of the invention. Other types of packers may be constructed, and other types of annular barriers may be formed, without departing from the principles of the invention.

For example, an annular barrier could be formed in conjunction with a tubing, liner or casing hanger, a packer may or may not include an anchoring device for securing a tubular string, a bridge plug or other type of plug may include an annular barrier, etc. Thus, the invention is not limited in any manner to the details of the well system 10 described herein.

Each of the packers 18, 20 includes a seal assembly with a swellable seal material which swells when contacted by an appropriate well fluid. The term "swell" and similar terms (such as "swellable") are used herein to indicate an increase in volume of a seal material. Typically, this increase in volume is due to incorporation of molecular components of the well fluid into the seal material itself, but other swelling mechanisms or techniques may be used, if desired.

When the seal material swells in the well system 10, it expands radially outward into contact with the inner surface of the casing string 16 (in the case of the packer 18), or the inner surface of the wellbore 14 (in the case of the packer 20). Note that swelling is not the same as expanding, although a seal material may expand as a result of swelling.

For example, in conventional packers, a seal element may be expanded radially outward by longitudinally compressing the seal element, or by inflating the seal element. In each of these cases, the seal element is expanded without any increase in volume of the seal material of which the seal element is made.

Various techniques may be used for contacting the swellable seal material with appropriate well fluid for causing swelling of the seal material. The well fluid may already be present in the well when the packers 18, 20 are installed in the well, in which case the seal assemblies of the packers preferably include features (such as absorption delaying coatings or membranes, swelling delayed material compositions, etc.) for delaying the swelling of the seal material.

Alternatively, the well fluid which causes swelling of the seal material may be circulated through the well to the packers 18, 20 after the packers are in the well. As another alternative, the well fluid which causes swelling of the seal material may be produced into the wellbore 14 from a formation surrounding the wellbore. Thus, it will be appreciated that any method may be used for causing swelling of the seal material of the packers 18, 20 in keeping with the principles of the invention.

The well fluid which causes swelling of the seal material could be water and/or hydrocarbon fluid. For example, water or hydrocarbon fluid produced from a formation surrounding the wellbore 14 could cause the seal material to swell.

Various seal materials are known to those skilled in the art, which seal materials swell when contacted with water and/or hydrocarbon fluid, so a comprehensive list of these material will not be presented here. Partial lists of swellable seal materials may be found in U.S. Pat. Nos. 3,385,367 and 7,059,415, and in U.S. Published Application No. 2004-0020662, the entire disclosures of which are incorporated herein by this reference. However, it should be understood that any seal material which swells when contacted by any type of well fluid may be used in keeping with the principles of the invention.

Figure 2:
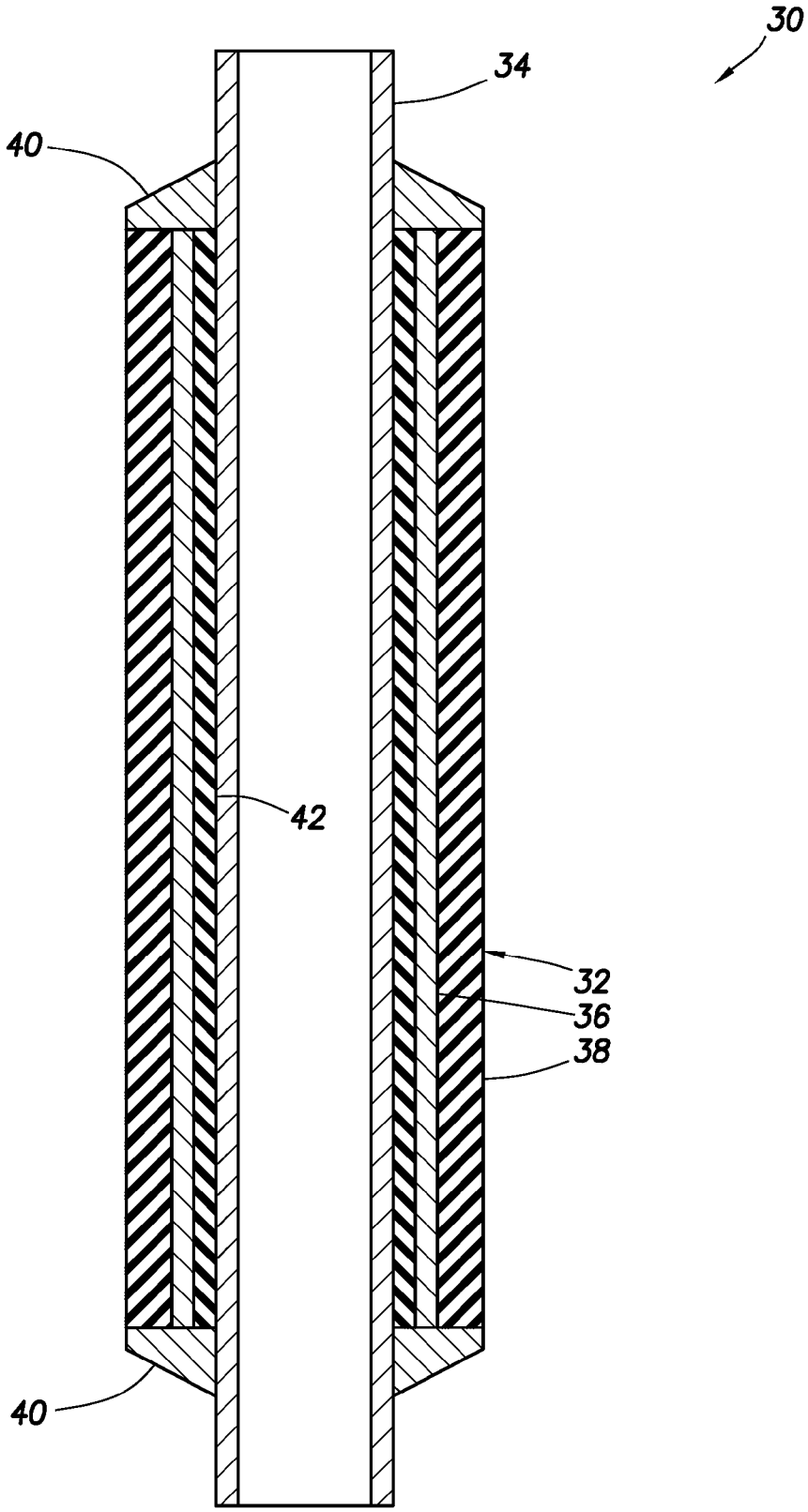
FIG. 2 is an enlarged scale schematic cross-sectional view of a swellable packer construction which embodies principles of the present invention.

Referring additionally now to FIG. 2, a swellable packer construction 30 which embodies principles of the present invention is representatively illustrated. The packer construction 30 may be used for either of the packers 18, 20 in the well system 10. The packer construction 30 may also be used for any other type of packer, and in any other type of well system, in keeping with the principles of the invention.

The packer construction 30 includes a seal assembly 32 and a base pipe 34. The base pipe 34 may be made of any type of material, may be any length or thickness, may have any type of end connections, may be radially expandable, etc. Thus, it is one of the many benefits of the packer construction 30 that various base pipes may be used with a given seal assembly 32.

For example, the base pipe 34 could be a length of conventional production tubing, coiled tubing or liner already present at a wellsite. In that case, it would only be necessary to install the seal assembly 32 on the tubing or liner to form the packer construction 30.

In this manner, there is no need to manufacture, inventory and distribute different packer constructions for different wellsite applications. Only the seal assembly 32 need be manufactured to suit the different wellsite applications.

Of course, a complete packer construction 30 could be made for each individual application prior to delivery to a corresponding wellsite. However, even in this case it would not be necessary to inventory each of the separate packer constructions. Instead, the seal assembly 32 could be matched to an appropriate base pipe 34 after the specific application is known.

When the seal assembly 32 is manufactured, it preferably includes a reinforcement material 36 embedded within a swellable seal material 38. The reinforcement material 36 preferably provides increased rigidity to the seal assembly 32 for convenient installation on the base pipe 34.

Note that the seal material 38 is preferably positioned both external relative to the reinforcement material 36 (for sealing contact with a well surface, such as the casing string 16 or the wellbore 14) and internal relative to the reinforcement material (for sealing contact with the base pipe 34).

In another beneficial feature of the packer construction 30, the seal material 38 preferably contacts the base pipe 34 over substantially the entire length of the seal assembly 32 between its opposite ends. Thus, enhanced sealing contact is provided between the seal assembly 32 and the base pipe 34, even though the seal assembly may not be molded or otherwise bonded onto the base pipe.

The reinforcement material 36 is preferably in the form of a cylindrical sleeve, and is preferably made of metal. However, other forms and materials may be used for the reinforcement material 36 in keeping with the principles of the invention.

The reinforcement material 36 is preferably embedded in the seal material 38 by molding the reinforcement material in the seal material. This method will provide a convenient, integral and economical construction. However, other methods of embedding the reinforcement material 36 in the seal material 38 (such as piecewise construction) may be used in keeping with the principles of the invention.

End rings 40 may be used to secure the seal assembly 32 on the base pipe 34, and to prevent extrusion of the seal material 38 in the annular gap between the base pipe and the well surface against which the seal material seals. The end rings 40 may be attached to the base pipe 34 before or after the seal assembly 32 is installed on the base pipe. The end rings 40 may be attached to the base pipe 34 using any appropriate techniques (such as welding, mechanical fasteners, adhesive bonding, etc.).

Various methods may be used for installing the seal assembly 32 on the base pipe 34. For example, the base pipe 34 may be inserted longitudinally through an inner passage 42 of the seal assembly 32. Alternatively, a longitudinal slit (not visible in FIG. 2) may be provided in the seal assembly 32, so that the base pipe 34 can be installed laterally through the slit into the inner passage 42. This latter method may be more useful when the seal assembly 32 is very long and/or the base pipe 34 has a rough or irregular outer surface.

To further enhance the sealing contact between the seal material 38 and the outer surface of the base pipe 34, a sealant may be used between these elements when the base pipe is installed in the seal assembly 32. Alternatively, it is possible that the seal material 38 may not sealingly contact the base pipe 34 until the seal material swells in the well.

Figure 3:
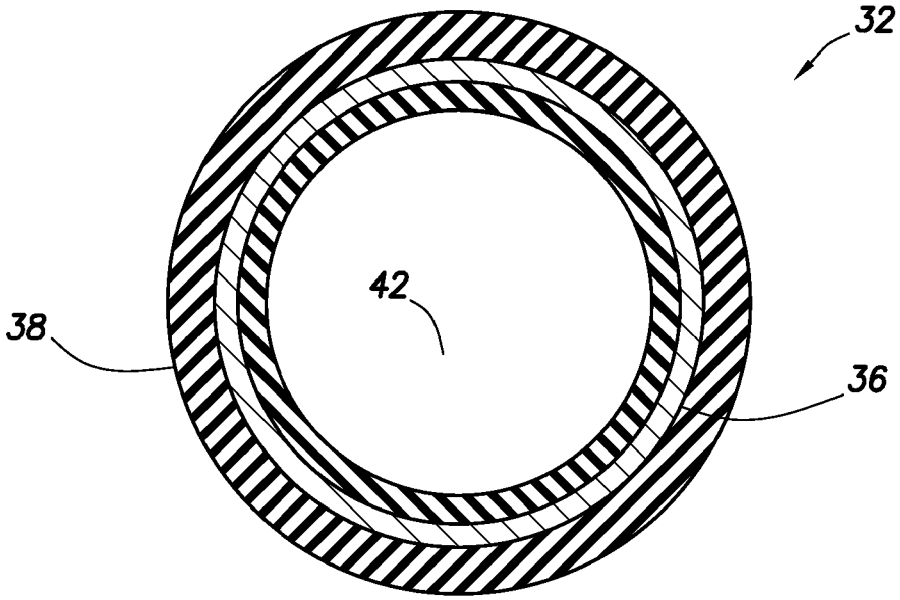
FIGS. 3-7 are further enlarged scale schematic cross-sectional views of various construction techniques for use in the packer construction of FIG. 2.

An enlarged scale cross-sectional view of one example of the seal assembly 32 is representatively illustrated in FIG. 3. In this example, the reinforcement material 36 and the seal material 38 are formed in complete tubular shapes, with the reinforcement material embedded in the seal material. After manufacturing the seal assembly 32, the appropriate base pipe 34 would preferably be inserted through the inner passage 42 of the seal assembly to form the packer construction 30.

Figure 4:
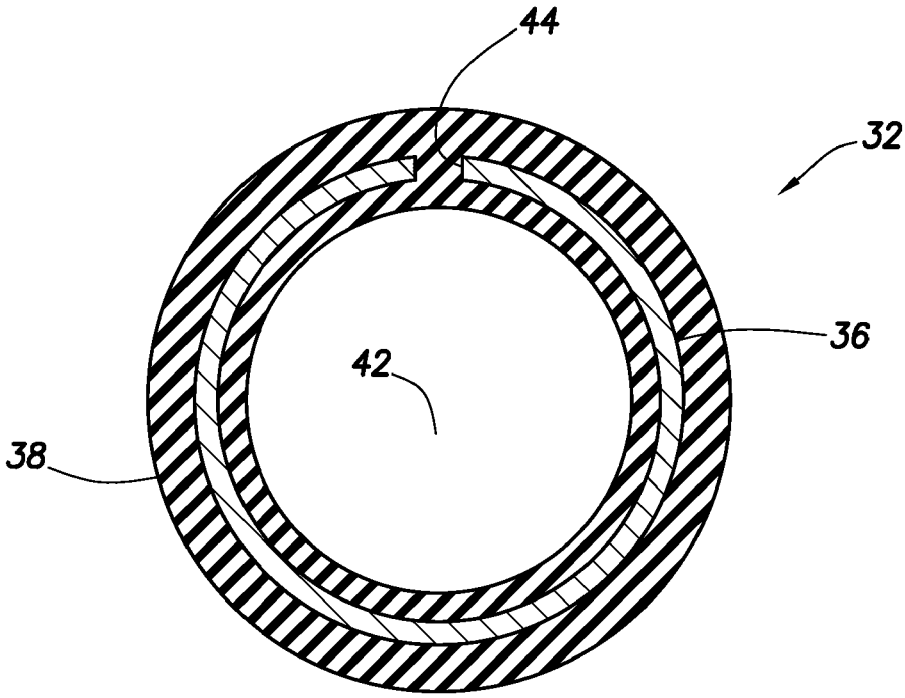

A cross-sectional view of another example of the seal assembly 32 is representatively illustrated in FIG. 4. In this example, the seal material 38 is formed in a complete tubular shape, but the reinforcement material 36 has a longitudinal slit 44 formed through it.

This longitudinal slit 44 permits convenient installation of the seal assembly 32 on the base pipe 34, in a manner described more fully below. In addition, this slit 44 permits the seal assembly 32 to be resealed longitudinally when the seal material 38 swells in the well, as described more fully below.

Figure 5:
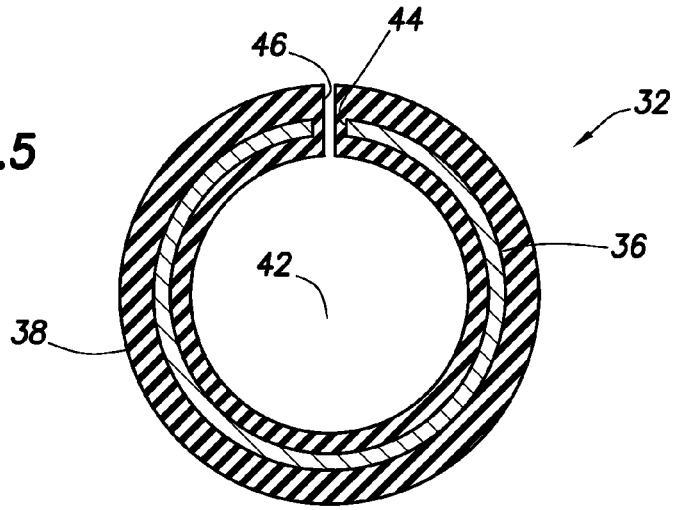

Referring additionally now to FIG. 5, the seal assembly 32 of FIG. 4 is representatively illustrated after another longitudinal slit 46 is formed through the seal assembly 32 at the location of the slit 44 in the reinforcement material 36. The slit 46 in the seal assembly 32 may be formed at any time, for example, when the seal material 38 is molded, or after the seal material is molded, etc.

Figure 6:
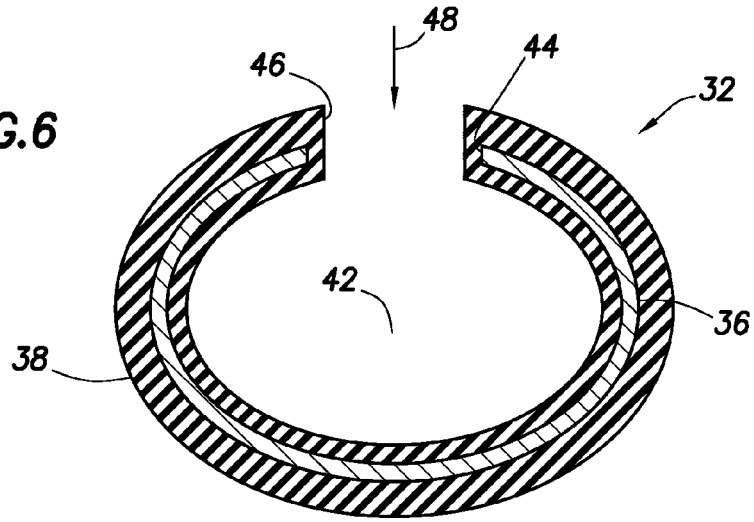

The slit 46 permits the seal assembly 32 to be opened up as depicted in FIG. 6, so that the base pipe 34 can be inserted laterally through the slit 46 and into the passage 42 (in the direction indicated by the arrow 48). Alternatively, the base pipe 34 could be inserted longitudinally through the passage 42 (as with the example of FIG. 3), with the slit 46 enabling the seal assembly 32 to enlarge as needed to accommodate any irregularities on the outer surface of the base pipe and/or to reduce friction between the seal assembly and the base pipe.

Preferably, the reinforcement material 36 is resilient and will provide a gripping force to secure the seal assembly 32 on the base pipe 34. However, it is not necessary for the reinforcement material 36 to be resilient or to provide such a gripping force in keeping with the principles of the invention.

Figure 7:
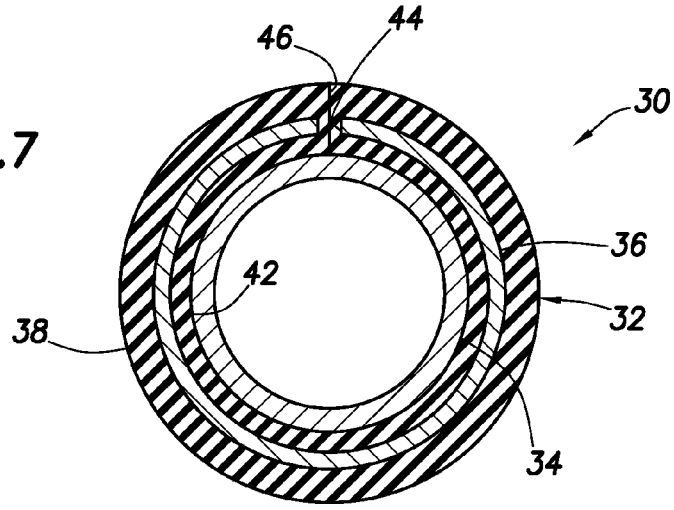

The completed packer construction 30 is depicted in FIG. 7, with the base pipe 34 installed in the seal assembly 32. Note that the slit 46 is closed, or is at least sufficiently closed, so that when the seal material 38 swells in the well the slit will be sealed off and leakage therethrough will be prevented.

A sealant and/or adhesive may be used in the slit 46, if desired, to enhance sealing contact therein. A sealant and/or adhesive may also be used between the seal assembly 32 and the base pipe 34 to enhance sealing contact and/or to secure the seal assembly on the base pipe. Clamps, ties, or other attachment devices may also, or alternatively, be used to secure the seal assembly 32 on the base pipe 34.

It may now be fully appreciated that the packer construction 30 which incorporates principles of the present invention provides several advances over prior swellable packers. For example, there is no need to manufacture, inventory and distribute different packer constructions for each wellsite application. In addition, the reinforcement material 36 in the seal material 38 provides increased rigidity in the seal assembly 32. Furthermore, various techniques may be used for conveniently assembling the seal assembly 32 and base pipe 34.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of forming an annular barrier in a subterranean well, the method comprising the steps of:

forming a first longitudinal slit through a reinforcement material;

then embedding the reinforcement material within a swellable seal material, thereby forming a seal assembly; and swelling the seal material by contacting the seal material with a fluid in the well.

2. The method of claim 1, wherein the reinforcement material comprises a metal material.

3. The method of claim 1, wherein the reinforcement material is in the form of a sleeve.

4. The method of claim 1, further comprising the steps of:

installing the seal assembly on a base pipe; and positioning the base pipe in the subterranean well.

5. The method of claim 4, wherein the seal assembly is installed on the base pipe by inserting the base pipe longitudinally through an inner passage of the seal assembly.

6. The method of claim 5, wherein the installing step is performed after the embedding step.

7. The method of claim 4, wherein the seal assembly is installed on the base pipe by inserting the base pipe laterally through a second longitudinal slit formed through the seal material.

8. The method of claim 7, wherein the installing step is performed after the embedding step.

9. The method of claim 1, wherein in the embedding step, the seal material is cylindrical shaped and is disposed both external and internal relative to the reinforcement material.

10. The method of claim 4, wherein the seal material contacts an outer surface of the base pipe over substantially an entire length of the seal assembly.

11. The method of claim 10, wherein the swelling step further comprises the seal material sealingly contacting a well surface external to the seal assembly, and the seal material sealingly contacting the outer surface of the base pipe.

12. A method of constructing a well packer, the method comprising the steps of:

embedding a resilient reinforcement material in a swellable seal material to thereby form a seal assembly; and then installing the seal assembly on a base pipe, the reinforcement material providing a gripping force which secures the seal assembly to the base pipe.

13. The method of claim 12, wherein the reinforcement material in the embedding step is a metal material.

14. The method of claim 12, wherein the reinforcement material in the embedding step is in the form of a sleeve.

15. The method of claim 14, further comprising the step of forming a longitudinal slit through the sleeve prior to installing the seal assembly on the base pipe.

16. The method of claim 12, wherein the installing step further comprises inserting the base pipe longitudinally through an inner passage of the seal assembly.

17. The method of claim 12, wherein the installing step further comprises inserting the base pipe laterally through a longitudinal slit formed through the seal assembly.

18. The method of claim 12, wherein in the embedding step, the seal material is cylindrical shaped and is disposed both external and internal relative to the reinforcement material.

19. The method of claim 12, wherein the installing step further comprises the seal material contacting the base pipe between opposite ends of the seal assembly.

20. A swellable packer construction, comprising:

a seal assembly including a swellable seal material having a reinforcement material embedded therein, the seal material being cylindrical shaped and disposed both external and internal relative to the reinforcement material, the reinforcement material including a longitudinal slit extending a full length of the reinforcement material, and the seal material being swellable in response to contact with well fluid in a well.

21. The packer construction of claim 20, further comprising a base pipe, and wherein the seal material is positioned for sealing contact with the base pipe.

22. The packer construction of claim 21, wherein the seal assembly is configured to permit insertion of the base pipe longitudinally into an inner passage of the seal assembly.

23. The packer construction of claim 21, wherein the seal assembly includes a longitudinal slit permitting insertion of the base pipe laterally through the slit and into an interior of the seal assembly.

24. The packer construction of claim 21, wherein the seal material sealingly contacts the base pipe along substantially an entire length of the seal assembly.

25. The packer construction of claim 20, wherein the reinforcement material is in the form of a sleeve.

26. The packer construction of claim 20, wherein the reinforcement material comprises a metal material.

* * * * *